United States Patent [19]

Montanier

[11] Patent Number: 5,004,156

[45] Date of Patent: Apr. 2, 1991

[54] WASHING DEVICE MOUNTED ON A MOTOR VEHICLE AND COMPRISING A ROTARY WASHING ARM WHICH DELIVERS JETS OF PRESSURIZED HOT WATER FOR CLEANING VARIOUS SURFACES

[76] Inventor: Gérard Montanier, 24 Boulevard Emile-Genevoix, 93230 Romainville, France

[21] Appl. No.: 368,300

[22] PCT Filed: Oct. 10, 1988

[86] PCT No.: PCT/FR88/00501

§ 371 Date: Jun. 9, 1989

§ 102(e) Date: Jun. 9, 1989

[87] PCT Pub. No.: WO89/03456

PCT Pub. Date: Apr. 20, 1989

[30] Foreign Application Priority Data

Oct. 9, 1987 [FR] France ..... 87 13956

[51] Int. Cl.[5] ..... B05B 1/24; E01H 1/10

[52] U.S. Cl. ..... 239/130; 239/160; 239/161; 239/163; 239/164; 239/172; 239/246; 239/597; 15/340.1

[58] Field of Search ..... 239/130, 146, 160, 161, 239/163, 164, 172, 176, 251, 597, 598, 246, 263, 263.1, 263.2; 15/340.1, 340.3, 340.4

[56] References Cited

U.S. PATENT DOCUMENTS

| | | | |
|---|---|---|---|
| 900,015 | 9/1908 | Hill | 239/160 X |
| 1,388,510 | 8/1921 | Cartwright | 239/119 |
| 2,995,307 | 10/1961 | McMahon | 239/161 |
| 3,086,713 | 4/1963 | Moldenhauer | 239/130 X |
| 3,481,544 | 12/1969 | Jackson | 239/130 |
| 3,690,559 | 9/1972 | Rudloff | 239/163 |
| 3,720,226 | 3/1973 | Minich et al. | 239/130 X |
| 3,832,069 | 8/1974 | Petsch | 239/251 X |
| 3,877,643 | 4/1975 | Smith et al. | 239/160 X |
| 3,886,623 | 6/1975 | Landesman et al. | 15/340.3 X |
| 3,997,114 | 12/1976 | Hewett | 239/130 X |
| 4,022,385 | 5/1977 | Krueger | 239/598 X |
| 4,106,516 | 8/1978 | Wiegand | 239/165 X |
| 4,191,590 | 3/1980 | Sundheim | 239/251 X |
| 4,427,154 | 1/1984 | Mercil | 239/161 |

FOREIGN PATENT DOCUMENTS

| | | | |
|---|---|---|---|
| 0196978 | 10/1986 | European Pat. Off. . | |
| 715262 | 11/1941 | Fed. Rep. of Germany | 239/246 |
| 2222981 | 1/1973 | Fed. Rep. of Germany . | |
| 2257607 | 5/1974 | Fed. Rep. of Germany . | |
| 2515892 | 10/1975 | Fed. Rep. of Germany . | |
| 545951 | 10/1922 | France | 239/246 |
| 2515536 | 5/1983 | France . | |
| 2584747 | 1/1987 | France . | |
| 2024611 | 1/1980 | United Kingdom . | |

OTHER PUBLICATIONS

"Die Chem.-Techn. Industrie.", Seifen-Ole-Fette-Wachse, vol. 97, No. 8, Apr. 15, 1971 by A. Pollack, pp. 249-253.

*Primary Examiner*—Andres Kashnikow
*Assistant Examiner*—William Grant
*Attorney, Agent, or Firm*—Young & Thompson

[57] ABSTRACT

A washing device mounted on a motor vehicle comprises cold water tanks and a high pressure boiler providing water at 100 to 250 bars. A rotary cleaning arm is supplied with the pressurized hot water and has nozzles at its ends directed towards the surface to be cleaned. A protective casing surrounds the rotary cleaning arm. The cleaninig arm can be mounted underneath the vehicle for vertical movement between operative and standby positions. The rotary arm has a rotation axis passing through its center and is provided with a nozzle at each end, the two nozzles being substantially identical, of flat triangular shape and having the same mean general plane. The nozzle therefore deliver two divergent flat jets that are substantially coplanar and which have different angles of attack on the surface to be cleaned. These jets can impinge on the opposite edges of an element of an irregular surface comprising facets perpendicular to the general plane of the surface, such as cobblestones and duckboards.

25 Claims, 6 Drawing Sheets

WASHING DEVICE MOUNTED ON A MOTOR VEHICLE AND COMPRISING A ROTARY WASHING ARM WHICH DELIVERS JETS OF PRESSURIZED HOT WATER FOR CLEANING VARIOUS SURFACES

The present invention concerns the washing of dirty surfaces such as ground surfaces or floors, walls and ceilings using a device mounted on a motor vehicle.

Devices of this kind as currently used for cleaning ground surfaces or floors comprise a fixed high-flowrate, low-pressure washing manifold dispensing cold water. The manifold comprises a large number of nozzles so as by displacement of the vehicle to cover a given working area. Hot water cannot be employed in these known devices because of the high water flowrate (6 to 20 $m^3/h$) needed. The vehicle comprising a device of this kind has a chassis which carries a tank which, given the high water flowrate, has to be large to enable the vehicle to function without replenishment for a particular time period.

In theory the tank could be filled with hot water before the vehicle sets out for a cleaning run, but it would then be necessary to provide good thermal insulation of the tank for the temperature of the water not to fall excessively, especially in winter.

What is more, it would also be necessary to provide a source of hot water at a specific location, which would reduce the autonomy and utility of the vehicle.

The above considerations explain why known washing devices comprise a fixed manifold which delivers only fixed direction low-pressure jets of cold water with the result that the jets have no cleaning effect on surfaces soiled with oil, grease or like materials. An object of the invention is a washing device mounted on a motor vehicle having a strong cleaning effect on surfaces including surfaces soiled by oil, grease and the like.

A washing device in accordance with the invention comprising at least one cold water tank and means for heating water which supply, with the aid of pumping means and pipes, at least one rotary cleaning arm fitted with at least one nozzle capable of directing a jet of hot water under pressure onto a surface to be cleaned is characterized in that the heating means comprise at least one high-pressure boiler adapted to deliver hot water at a pressure of between 100 and 250 bars.

The pressure is provided by the pumping means which advantageously comprise to this end a high-pressure volumetric pump.

These arrangements make it possible to obtain a jet of pressurized hot water which has a strong cleaning effect on the surfaces on which it impinges because the jet has a high kinetic energy and its high temperature serves to soften or even melt oil and grease and to separate them from the washed surface.

The high power of the jets makes it possible to reduce their transverse cross-section and therefore the flowrate of each nozzle mounted on the rotary arm. This results in particularly low consumption of hot water and considerable autonomy of the cleaning vehicle.

In a first embodiment of the invention, advantageous for washing ground surfaces or floors, the rotary arm is disposed substantially horizontally and has a substantially vertical axis of rotation; said arm is situated beneath the vehicle, each nozzle being oriented to direct a jet of hot water towards the ground surface or floor to be cleaned.

This device also comprises means for adjusting the height of the rotary arm relative to the ground surface or floor to be cleaned between a cleaning position and a standby position.

These characteristics make it possible to obtain cleaned strips of ground surface or floor which result from the envelope of displacement of the annular surface cleaned by one revolution of the rotary arm situated beneath the vehicle. In the case of rectilinear displacement of the vehicle there is obtained a cleaned strip of uniform width over substantially all its length. With this arrangement the device is particularly suitable for cleaning roads, airplane runways and other oily ground surfaces.

In a second embodiment of the invention the vehicle is provided with a single rotary arm and the device is characterized in that it comprises an articulated member having the rotary cleaning arm disposed at its free end that can be oriented and deployed to clean walls, ceilings, floors, ground surfaces and surfaces with diverse orientations.

This latter development makes it possible to clean industrial premises, noise barrier walls on expressways behind the crash barrier, industrial premises and road tunnels. If the motor vehicle is adapted to run on rails it can then clean rail tunnels.

In a preferred embodiment of the invention the rotary arm has a rotation axis passing through its center and is provided with a nozzle at each end, the two nozzles being substantially identical, of flat triangular shape and having the same mean general plane. The nozzles therefore deliver two divergent flat jets that are substantially coplanar and which have different angles of attack on the surface to be cleaned. These jets can impinge on the opposite edges of an element of surface comprising facets perpendicular to the general plane of the surface, such as cobblestones and duckboards.

The characteristics and the advantages of the invention will emerge from the following description by way of example with reference to the appended schematic drawings in which.

Figure 1:
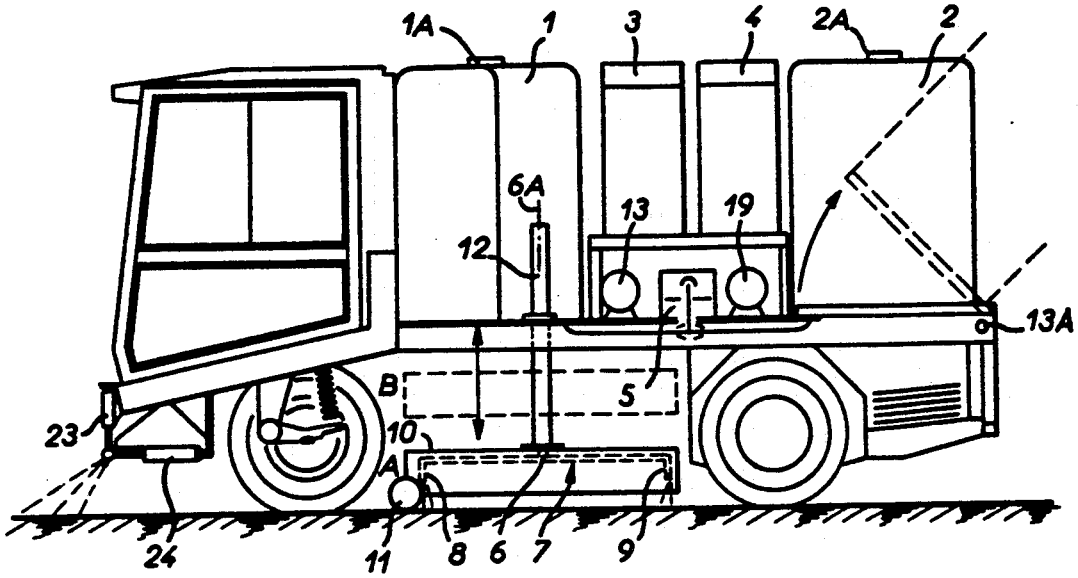
FIG. 1 is a view in elevation of a first embodiment of a ground or floor washing device mounted on an automobile vehicle in accordance with the invention.
Figure 2:
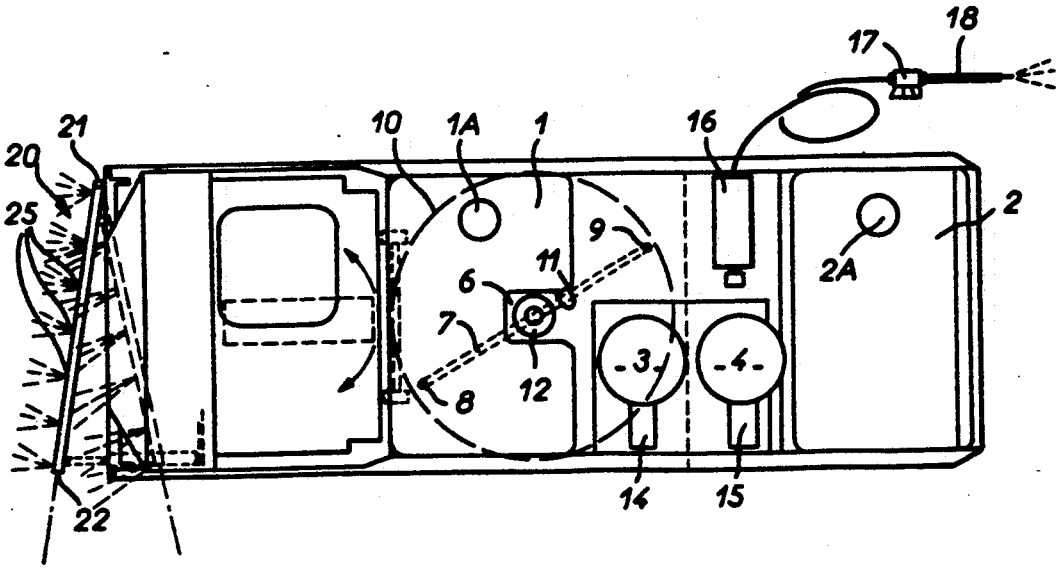
FIG. 2 is a plan view of the vehicle from FIG. 1.

In the selected first embodiment shown in FIGS. 1 and 2 a washing device is mounted on a three-wheel vehicle with known propulsion means.

To the rear of the control cab the chassis, which is in the general form of a horizontal plate, carries two cold water tanks 1, 2 which feed two vertical boilers 3, 4 through a high-pressure pump 5 which produces a high pressure in all the pipes. The boilers 3, 4 in turn feed through pipes and a rotary joint a rotary shaft 6 of a substantially horizontal cleaning arm 7 the rotation axis 6A of which is substantially vertical and which is provided at its end with two nozzles 8, 9 the orifices in which are directed towards the ground. The cleaning arm 7 is situated beneath the vehicle, between the wheels, and is protected in rotation by a protective casing 10. The protective casing 10 is provided with guide rollers 11 (only one of which is shown) and is linked by fixing members to the outside part of the rotary joint, which will be described later. For reasons of convenience in driving the vehicle it is preferable if the dimensions of the casing situated between the wheels of the vehicle do not exceed the width of the vehicle. In the case of a casing in the shape of a cylinder of revolution its diameter will therefore be equal to or less than the width of the vehicle.

To go into more detail, the tank 1, called the front tank because it is nearer the driving cab, is substantially the shape of a right parallelepiped the dimensions of which do not exceed the height of the cab and the width of the vehicle.

The tank 1 has an orifice 1A for filling it with cold water and a concave recess 11 in its posterior surface to provide the space needed for a ram 12 for raising the rotary shaft 6 carrying the rotary arm 7 and the casing 10. The raising ram constitutes means for adjusting the height of the rotary arm relative to the ground to be cleaned between a cleaning position A and a standby position B. The tank 2, called the rear tank because it is near the rear edge of the vehicle, has substantially the same parallelepiped shape as the tank 1 and similarly has a filler orifice 2A.

The rear tank 2 is mounted on a pivoted subframe which can tilt about a hinge 13A to provide access to the motor of the vehicle. Heating means between the tanks 1 and 2 comprise the two vertical boilers 11 and 12 with oil burners 14, 15. Also provided is an automatic winder 16 for a flexible hose which terminates in a gun 17 provided with a lance 18 which can spray hot water at high pressure. This lance is used manually to clean surfaces where access is inconvenient. The vehicle chassis also carries the high-pressure volumetric pump 5, two hydraulic motor/alternator systems 13, of which only one is shown, to supply the electrical needs of the two burners and a low-pressure volumetric pump 19 for feeding cold water to a rinsing manifold 20 located at the bottom of the front surface of the driving cab.

A first end 21 of the manifold 20 is connected to a flexible cold water feed pipe and is supported by a ball-joint articulation. The closed second end 22 is fixed to a height adjustment ram 23 and an angle ram 24. The manifold 20 is provided all along its length with regularly spaced orifices 25. However it is positioned it cannot project beyond the width of the vehicle.

In another embodiment (not shown) of the manifold 20 the latter is at the rear of the vehicle rather than at the front. This arrangement makes it possible to perform washing by the rotary arm 7 and rinsing by the manifold 20 simultaneously, in a single pass by the vehicle. The disadvantage of this rear location is reduced visibility of the manifold to the vehicle driver, who then has to employ a system of rear-view mirrors.

Figure 3:
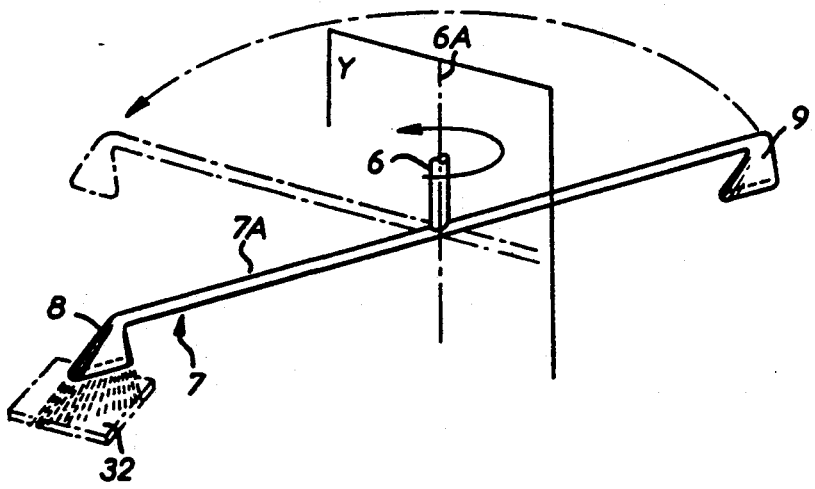
FIG. 3 is a perspective view of one particular embodiment of the rotary cleaning arm of the washing device in accordance with the invention.
Figure 4:
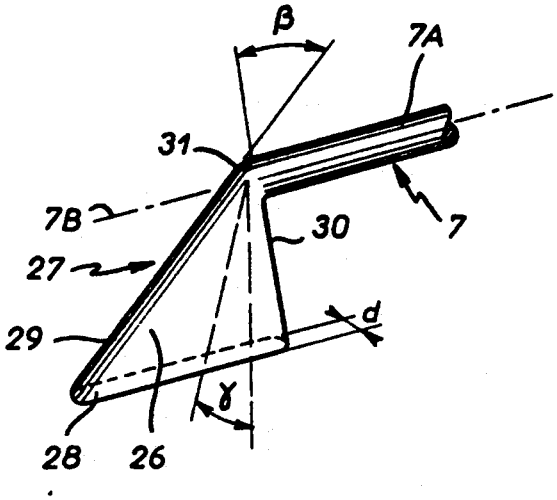
FIG. 4 is an enlarged perspective view of one of the nozzles of the rotary cleaning arm from FIG. 3.

FIGS. 3 and 4 show one preferred embodiment of the rotary cleaning arm 7 which is formed by a substantially rectilinear tube 7A perpendicular at its center to the axis 6A of the hollow rotary shaft 6. The tube is connected to a nozzle 8, 9 at each end. The nozzles 8 and 9 are identical and their general shape is that of a flat triangle. The nozzle 8 comprises a front surface 26 in the shape of an isosceles triangle and a rear surface 27 which is symmetrical to the front surface relative to a plane of symmetry X near and parallel to the front surface.

The distance between the two surfaces 26 and 27 defines the width d of the nozzle orifice 28. The facing surfaces which have substantially the same length are joined to form a rounded outer side 29 and a rounded inner side 30 of the nozzle. Attached to the inner side near the apex 31 of the nozzle is one end of the tube 7A so that the axis 7B of the tube 7A is in the mean general plane of the base and substantially parallel to the orifice 28.

The nozzle is characterized by its aperture angle $\beta$ which is equal to the angle at the apex of the isosceles triangle and by the angle $\gamma$ of inclination of its mean general plane to the rotation axis 6A. In the embodiment shown the two nozzles 8 and 9 have a mean general plane with an angle of inclination of approximately 10°. The aperture angle is equal to 40°. As a general rule, $\gamma$ can vary between 0° and 30° and $\beta$ can be chosen between 15° and 45°. A small aperture angle $\beta$ will increase the power of the jet as compared with a wide aperture. On the other hand, a wide aperture will contribute to attacking all the facets of small reliefs on the surface to be cleaned as the vehicle moves along. If the principal utilization of a washing device of this kind is known, then the angle $\beta$ will be small for very smooth surfaces that are very dirty but rather large for surfaces featuring many small reliefs.

In operation of this embodiment the high-pressure water jets are in the form of two flat jets which spread out with the angle $\beta$ and in the mean general plane. The two water jets are symmetrical relative to a plane Y passing through the rotation axis 6A and perpendicular to the axis 7B of the tube 7A.

This latter symmetry results in balanced reaction forces on the ends of the rotary arm 7 due to water leaving each nozzle 8, 9 at high speed.

A consequence of this symmetry of the reaction forces relative to the plane Y is that no rotation torque about the axis 6A is created by the water jets and so the rotary arm has to be rotated by a motor. This embodiment is advantageous because all the energy of the jets is applied to the surface to be cleaned without any part of this energy being consumed to rotate the rotary arm. If the rotation of the rotary arm 7 is fast in comparison with the speed of advance of the vehicle the same small element 32 of the surface will be overflown successively by the nozzle 8 and by the nozzle 9.

Figure 5:
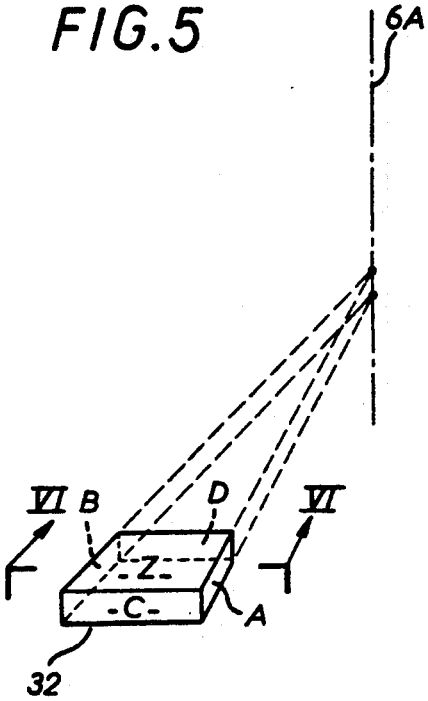
FIG. 5 is a perspective view of one element of a surface to be cleaned overflown successively by the nozzles of the rotary arm from FIGS. 4 and 5.
Figure 6:
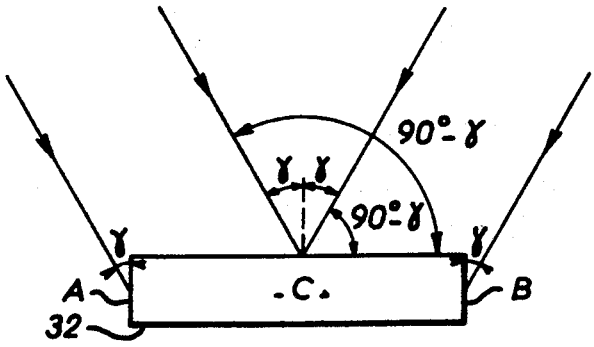
FIG. 6 is a cross-section on the line VI—VI in FIG. 5 showing the angles of attack of the jets.

As shown in FIGS. 5 and 6 in the case where the surface element 32 has a general plane Z substantially perpendicular to the rotation axis 6A the jet from the nozzle will impinge on the element 32 with an acute angle of attack equal to 90°−γ and then the jet from the nozzle 9 will impinge on it with an obtuse angle of attack equal to 90°+γ, the difference between the inclination of the two successive jets being 2γ. If this element has opposite facets A and B perpendicular to the general plane Z and each of which (for the clarity of the exposition) has its plane passing through the rotation axis 6A, the successive jets can then impinge on each facet A and B.

The first jet from the nozzle 8 will impinge on the facet A with the angle of attack γ without being able to reach the facet B but the second jet from the nozzle 9 will impinge on the facet B with the angle of attack γ without having beforehand impinged on the facet A. Similarly, the other two opposed facets C and D perpendicular to the general plane Z and parallel to the direction of displacement of the vehicle will have the jets impinge on them due to the conjugate action of the aperture of each nozzle, of the angle γ and of the progress of the vehicle with rotation of the rotary arm 7.

This particular arrangement of the two nozzles therefore facilitates the cleaning of small reliefs on the surface, such as cobblestones or duckboards.

In another embodiment (not shown) the two nozzles on the same rotary arm have angles of inclination γ of the same magnitude but opposite directions. The two jets then have the same angle of attack (obtuse or acute) on the surface to be cleaned and a rotation torque is exerted on the rotary arm as a reaction force, so that the arm does not need to be rotated by a motor.

In another embodiment (not shown) the rotary arm incorporates means for adjusting γ the angle of inclination γ of each nozzle. The angle γ may be adjusted between 0° and 30°. Each nozzle is then in one piece with a short segment of cylindrical tube connected to the end of the tube 7A of the rotary arm by any known connecting means, for example a flange-to-flange assembly using a gasket.

Figure 7:
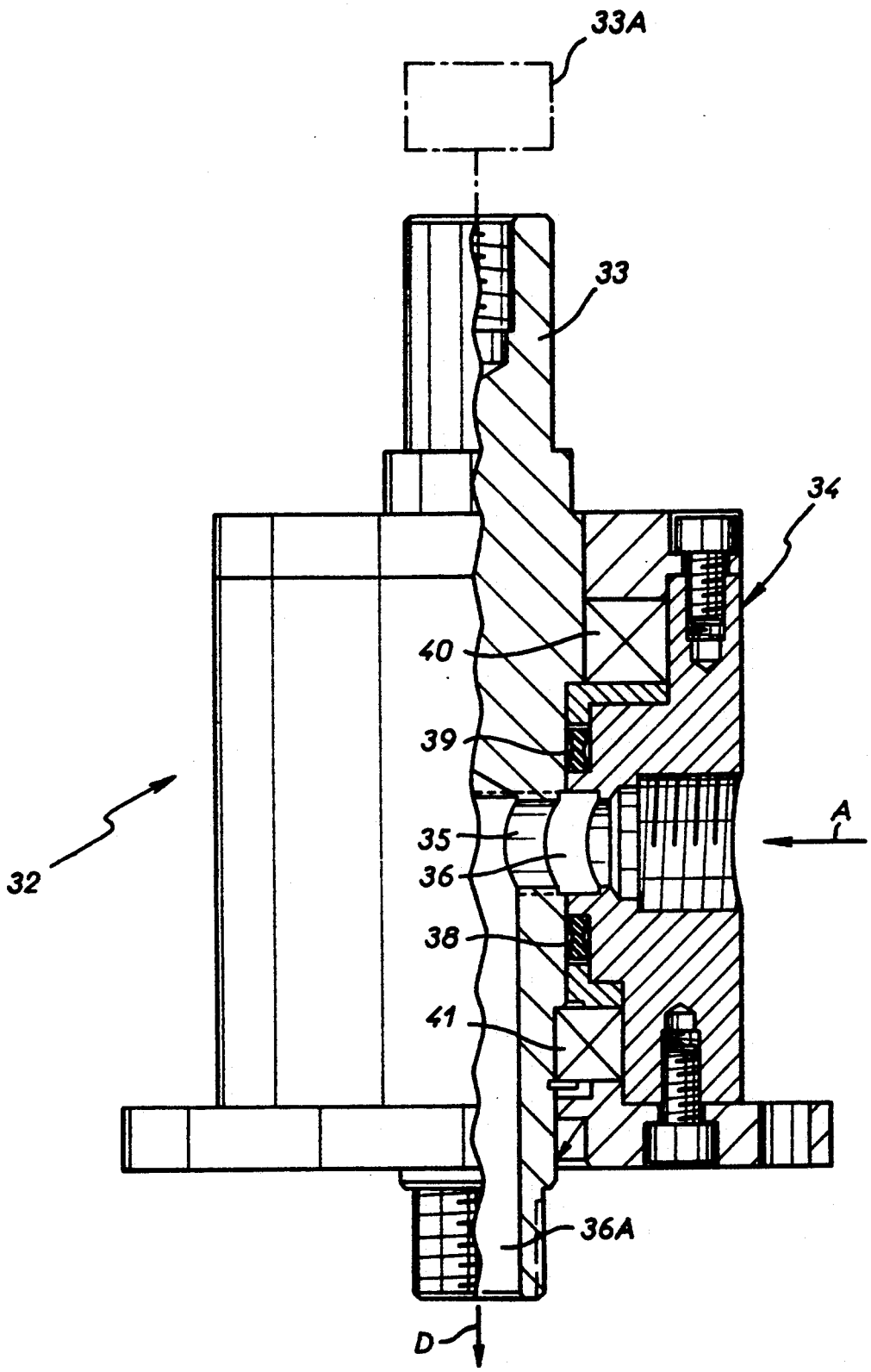
FIG. 7 is a part-sectioned view of a highpressure rotary joint enabling rotation of a rotary arm.

FIG. 7 shows a high-pressure rotary joint 32 which enables the rotary arm to rotate while feeding hot water to it.

The joint 32 is essentially in two parts: a shaft 33 can be rotated by a motor 70 within a cylindrical ring 34. The shaft 33 is provided with a radial bore 35 which communicates with an axial bore 36A designed to be connected to the rotary shaft 6 of the rotary arm 7. Irrespective of its angular position, the radial bore 35 in the shaft communicates with an annular chamber 36 in the cylindrical ring 34. A radial bore 37 passes through the cylindrical ring and opens into the chamber 36. Sealing is provided by annular seals 38, 39 situated between the shaft 33 and the cylindrical ring 34, to either side of the chamber 36 and axially spaced from each other. Two bearings 40, 41 guide rotation of the shaft.

In operation, pressurized hot water arriving as shown by the arrow A fills the chamber 36 and then the radial bore 35 in the shaft to leave the rotary seal as shown by the arrow D. The rotary joint 32 enables water flow at a maximum temperature of 140° C., a maximum pressure of 350 bars and a maximum rotation speed of 500 rpm.

Figure 8:
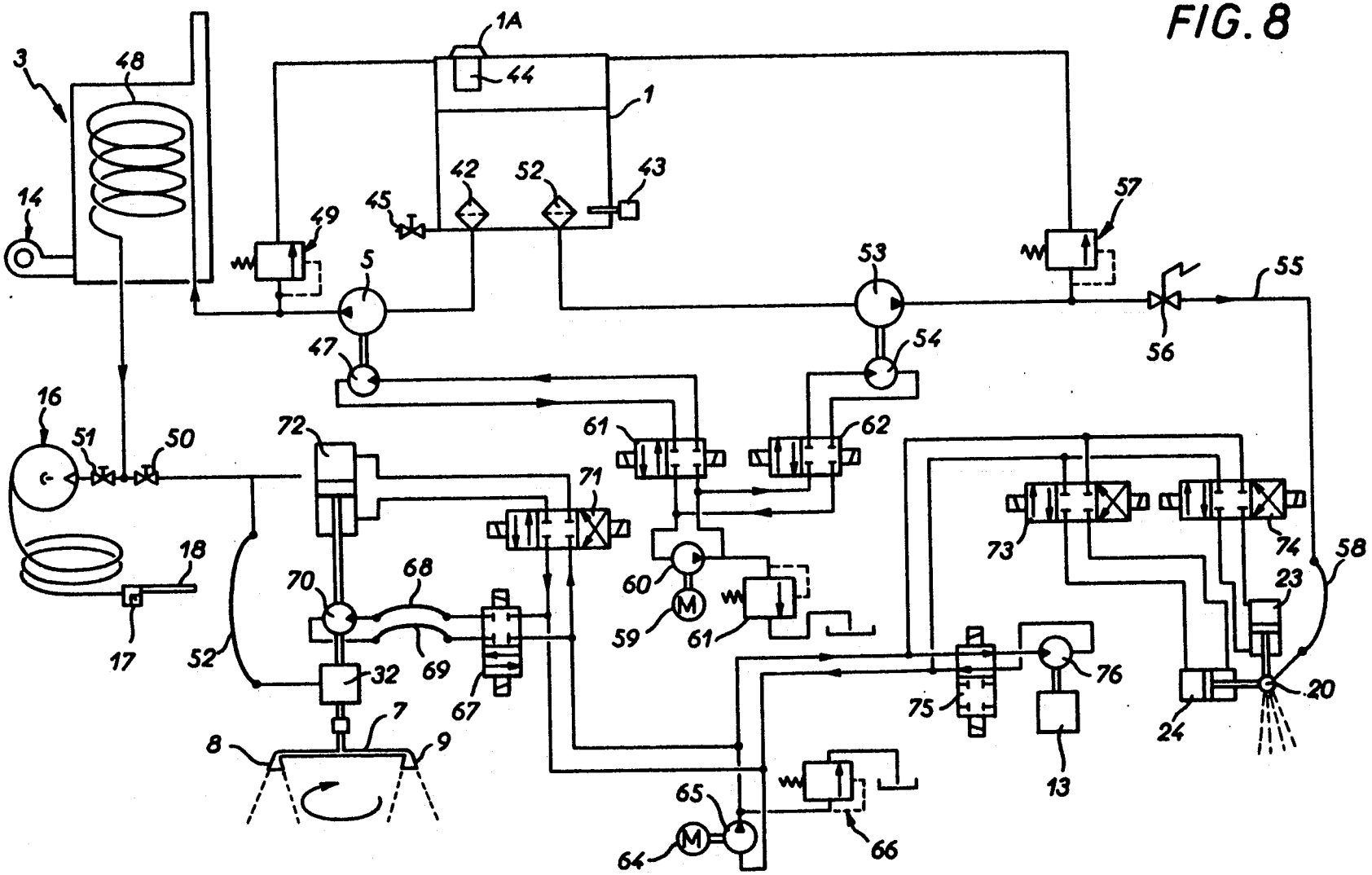
FIG. 8 is a general operation and control schematic for the first embodiment of washing device in accordance with the invention.

FIG. 8 shows an operation and control schematic for the first embodiment of the device in accordance with the invention. This schematic does not show the electrical power supply and control circuit, for which electrical energy is supplied by a generator located in the propulsion unit of the vehicle. It is therefore essentially the hydraulic circuits of the device in accordance with the invention that are shown.

These circuits comprise two pressurized water circuits and two pressurized hydraulic oil circuits.

The first water circuit takes water from the tanks (of which only the tank 1 is shown) through a filter 42. The tank 1 is fitted with a low level sensor 43 connected to the electrical circuit, a cartridge filter 44 at the filler orifice 1A and a drain valve 45. The water drawn off is pressurized by a high-pressure volumetric pump 46. This pump can provide a flowrate of 3 000 liters/hour at a maximum pressure of 250 bars. It is driven by a hydraulic motor 47.

The pump 46 feeds the water through the coil 48 of an oil burner boiler 3 (the second boiler 4 is not shown). This boiler is equipped with an oil burner 14, a flowrate controller (not shown) and a water outlet temperature thermostat (not shown). The thermostat is preferably set to a value between 50° and 25° C. Between the high-pressure pump 46 and the coil 48 is a pressure limiter 49 which when it operates can return water to the tank 1.

The hot water from the coil can be distributed by means of two valves 50, 51 either to the winder 16 carrying a flexible hose to the end of which is fixed the gun 17 fitted with its lance 18 or to the rotary arm 7. With the valve 51 closed and the valve 50 open the water flows back to the rotary joint 32 by way of a flexible hose 52. The nozzles 8 and 9 have an orifice 28 dimensioned so that the water is at the pressure of around 100 to 250 bars with a total flowrate between about 0.5 and 3 $m^3/h$.

Another water circuit feeds the rinsing manifold 20.

The water is drawn off from the tank 1 through a filter 52 and then pressurized by a low-pressure centrifugal pump 53. This pump can produce a water flowrate of 4 500 l/h and a maximum pressure of 7 bars. It is driven by a hydraulic motor 54. The pump 53 feeds cold water into the pipe 55 through a solenoid valve 56. Between the pump 53 and the solenoid valve 56 is a pressure limiter 57 which when it operates can return water to the tank 1.

From the pipe 55 the water passes through a flexible hose 58 to the manifold 20.

The first pressurized hydraulic oil circuit which feeds the two hydraulic motors 47 and 54 described above comprises a motor 59 which drives a volumetric pump 60. The motor 59 can be replaced by a drive output from the motor of the vehicle.

A pressure limiter 61 in a branch connection makes the system safe. The volumteric pump 60 feeds the hydraulic motor 47 through an electric 4/2 distributor 61. A branch connection between the pump 60 and the distributor 61 can conduct the hydraulic oil to the hydraulic motor 54 through an electric 4/2 distributor 62.

A second hydraulic circuit controls the positioning of the rotary arm 7 of the rinsing manifold 20 and the operation of an alternator 13 supplying the burner 14 with electric current. An electric motor 64 operates a hydraulic pump 65 which feeds all of the second circuit with pressurized oil. The motor 64 may be replaced by a drive output from the motor of the vehicle. The hydraulic pump is provided with a pressure limiter 66 and feeds through an electric 4/2 distributor 67 and two flexible hoses 68, 69 a hydraulic motor 70 which rotates the rotary arm 7 through the rotary joint 32. In a branch circuit between the electric distributor 67 and the pump 65, the circuit passes through an electric 4/3 distributor 71 supplying a double-acting ram 72 which is adapted to procure movement in translation in both directions of the assembly comprising the motor 70 coupled to the rotary joint 32 in turn coupled to the rotary arm 7. In the case of a rotary arm situated beneath the vehicle it is the ram 72 which raises and lowers the rotary arm 7 and its protective casing (not shown in FIG. 8). The same pump 65 feeds through two electric 4/3 distributors 73 and 74 which are in branch connections relative to each other the double-acting ram 23 for adjusting the height of the manifold 20 and the double-acting ram 24 for adjusting the angle of the manifold 20. Between the pump 65 and the electric distributor 73 a branch circuit through an electric 4/2 distributor 75 supplies a hydraulic motor 76 adapted to drive an alternator 13 supplying the burner 14 of the boiler 3.

The driving cab is provided with a control and regulation unit (not shown) which comprises:

a water level indicator connected to the low level sensor 43;

an on/off switch for the high-pressure pump 46;

an on/off switch for the low-pressure pump 53;

an on/off switch for the alternator 13;

an on/off switch for the boilers 3 and 4;

an up/down switch for the rotary arm 7 and its casing 10;

an on/off switch for rotation of the washing arm 7;

an up/down switch for the rinsing manifold 20;

a righthand/lefthand angular orientation switch for the rinsing manifold 20;

a rotating warning light switch.

This first embodiment of a washing device in accordance with the invention operates as follows: The vehicle with the tanks 1 and 2 filled with water reaches the washing site with the casing and rotary arm raised to the standby position. The driver lowers the rotary arm and begins cleaning strips of the surface to be cleaned using pressurized hot water.

To rinse and remove soiling detached by the action of the rotary arm the vehicle is driven over the surface again with the rinsing manifold operating and inclined either to the right or to the left so as to evacuate dirt either to the right or to the left of the vehicle.

This first embodiment of the invention makes it possible to clean effectively ground over which the vehicle can travel. To clean surfaces with various orientations situated in the space near the vehicle, such as the surfaces of walls, ceilings, tunnels and the ground there is provided in a second embodiment shown in FIGS. 9, 10, 11 and 12 a rotary arm 107 disposed at a free end of an articulated arm 200 that can be oriented and deployed. The other end of this arm is fixed to a pivoting boom 201 the bottom of which is fastened to the chassis of the motor vehicle which is in the form of a four-wheeled truck with across its full width at the front an orientable rinsing manifold 120 similar to that described in relation to the first embodiment of the invention.

To go into more detail, the boom 201 comprises a substantially vertical column 202 which is the shape of a cylinder of revolution and can pivot in both directions about its axis of revolution through a total angle of approximately 90°. At the upper end 203 of this column is attached a first segment 204 forming a bracket to constitute with the column the pivoting boom. The first segment 204 is rectilinear, hollow and at an obtuse angle to the axis of revolution of the column 202, which is preferably at the same distance from the two lateral sides of the vehicle. The arm segment 204 passes over the roof of the driving cab which incorporates a warning lamp and its end 205 directed towards the front projects slightly beyond the forward edge of the driving cab, over which it lies. The end 205 is articulated about a substantially horizontal axis 206 to a hollow second segment 207 of the articulated arm with two coaxial rotary actuators 208, 209 disposed head-to-tail which rotate in synchronism and identically through a total angle of approximately 225°. Two actuators are used to provide a combined torque sufficient to support and displace the remainder of the arm terminating at the washing head assembly. The actuators 208, 209 may be Doedijns type SM 2.200 FLO-TORK acutators, for example.

The hollow second segment 207 is articulated to a hollow third segment 210 with a rotary actuator 211 so that the two hollow segments 207, 210 are substantially coaxial with the rotation axis of the rotary actuator 211, which can pivot through an angle of 360°.

The actuator 211 incorporates a hollow shaft fastened to the third segment 210 and its frame structure is fastened to the second segment 207. This actuator may be a Flo-Tork hollow shaft hydraulic rotary actuator type 75 000, 150 000, 300 000 or 600 000, for example, the inside diameter of the hollow shaft being then between approximately 7 cm and approximately 9.5 cm.

The length of the segments 207 and 210 can be in any ratio, but the segment 207 is preferably longer than the segment 210.

It is important for the actuator 211 to have a hollow shaft because this makes provision for accommodating hydraulic fluid and water feed pipes and electrical cables for controlling the position of the casing 110, as will be described later.

The third segment 210 is articulated to a washing head assembly 212 with a rotary actuator 213 whose rotation axis 214 is at right angles to the rotation axis 211A of the previously mentioned rotary actuator 211.

The rotary actuator 213 may be a Doedijns ECKART series ND actuator, for example, with a size in the range from 63 through 200 (this is the piston size on millimeters).

The rotary actuator 213 is adapted to rotate through 360° but the washing head assembly in practise limits the possible pivoting of the washing head 212 relative to the third segment 210 to a value slightly less than 360°, namely around 300°. Successive rotations of the articulated actuators 211, 213 make it possible to impart to the casing 110 and to the washing arm virtually all possible orientations in space with only a very small dead angle which can be compensated for by angling the axis 206 between the first segment 204 and the second segment 207 with the aid of the acutators 208, 209.

The washing head assembly 212 comprises within a protective outer jacket 215 a hydraulic motor 170 driving through a rotary joint 132 the cleaning arm 107 provided with nozzles 108, 109. The cleaning arm rotates within a protective casing 110.

The casing 110 is in the form of a short cylinder of revolution and is open at one end to allow the jets from the nozzles 108 and 109 to pass through.

The opposite end of the casing 110 is provided with large orifices 206 so that it does not become transformed into a receptacle for water and dirt when cleaning ceilings in particular.

The casing 110 attached to the protective jacket 215 by means of sheet metal facing members 216 comprises on its periphery a number of sensor members 217 comprising microswitches connected electrically to an electronic system for sensing movements of the articulated arm 200. In the event of contact of any sensing member with the surface to be cleaned movement of the articulated arm is stopped by cutting off the supply of fluid to the actuators. Similarly, if the vehicle is in motion its movement is immediately stopped.

The rotary actuators 208, 209, 211, 213 are connected to hydraulic pumps (not shown) by means of flexible hoses situated outside the articulated arm 220.

Partly inside the articulated arm 200 are flexible hoses 220, 221 for connecting the hydraulic motor 170 to a volumetric pump (not shown) and a flexible hose 222 supplying pressurized hot water to the rotary cleaning arm 107.

The flexible hoses 220, 221, 222 pass inside the first segment 204 and then exit it to cross the axis of the rotary acutators 208, 209 and then re-enter the interior of the second segment 207, then that of the hollow shaft of the rotary actuator 211 to gain the interior of the third segment 210 from where, after bypassing the rotary actuator 213, they respectively connect to the hydraulic motor 170 and to the rotary joint 132. The electrical cables (not shown) connected to the sensing members 217 follow the same path within the articulated arm as the flexible hoses 220, 221, 222.

Figure 9:
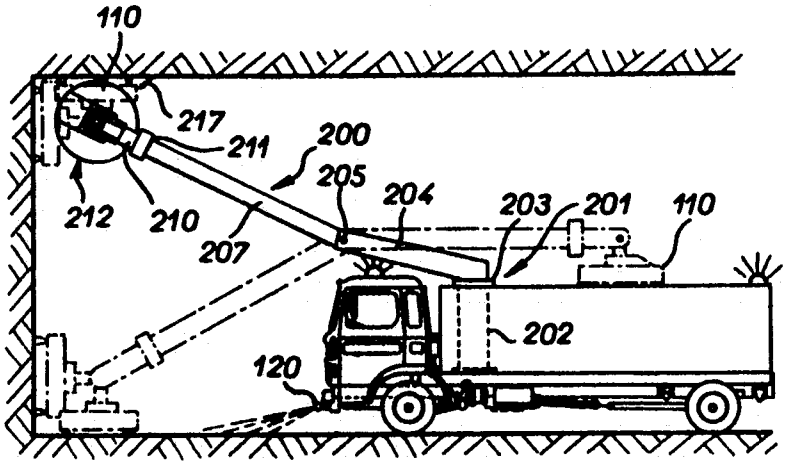
FIG. 9 is a side view of a second embodiment of washing device in which a rotary cleaning arm is disposed at the end of an articulated arm carried by a vehicle.

In the idle position as shown in FIG. 9, the protective casing 110 rests near the rear part of the roof of the vehicle as a result of backward folding of the articulated arm 200 by pivoting about the head-to-tail actuators 208, 209. This results in the equipped vehicle having the lowest possible overall height. In this embodiment the deployed length of the articulated arm as measured from the end 203 of the column 202 to the edge of the casing which in operation faces the surface to be cleaned is similar to the overall length of the vehicle.

The second embodiment of washing device in accordance with the invention operates as follows:

The vehicle arrives at the cleaning site with its washing arm in the idle position.

Figure 11:
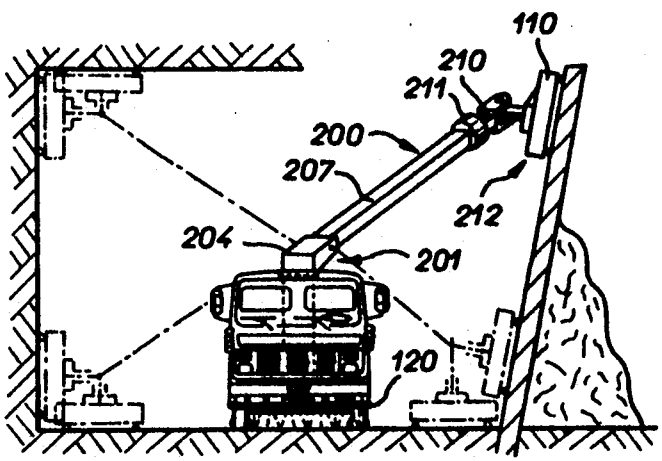
FIG. 11 is a front view of the vehicle equipped as shown in FIGS. 9 and 10.
Figure 10:
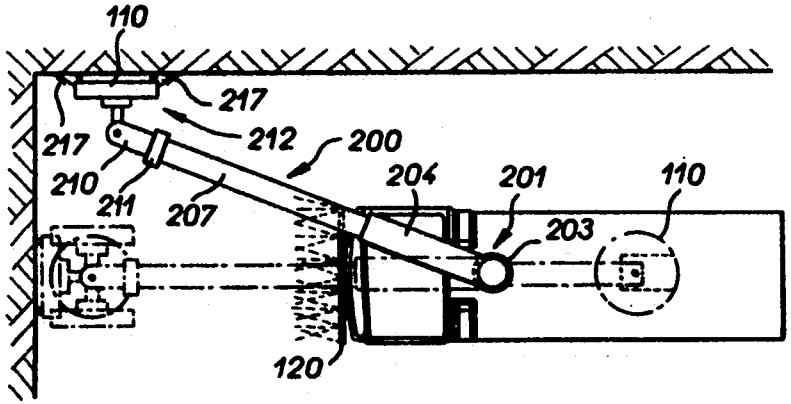
FIG. 10 is a plan view of the vehicle equipped as shown in FIG. 9.
Figure 12:
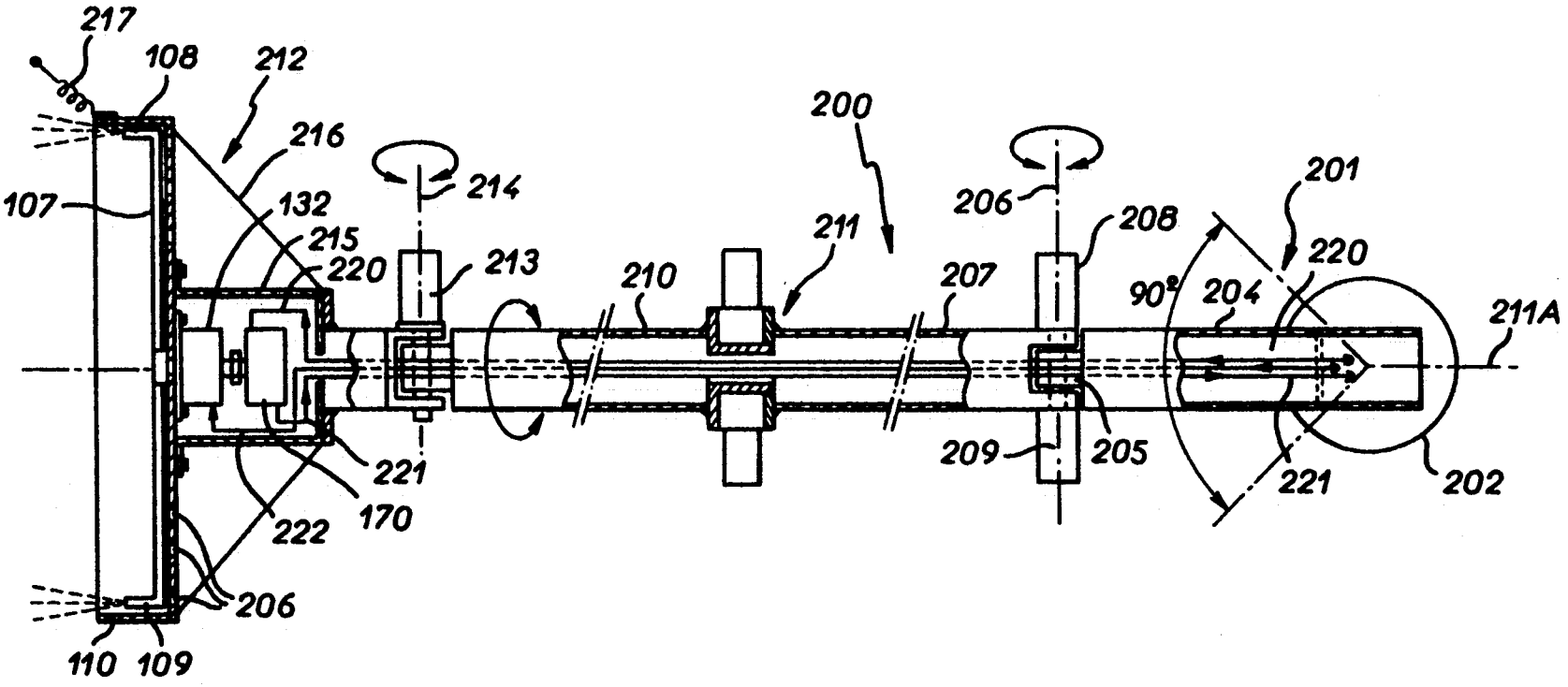
FIG. 12 is a detail view of the articulated arm carried by the vehicle shown in FIGS. 9, 10 and 11.

In a place where there is sufficient room heightwise the articulated arm is deployed so that it projects to the front of the driving cab. With the vehicle stationary the protective casing is brought carefully to the vicinity of the surface to be cleaned, and as closely parallel thereto as possible, as shown in FIGS. 9, 10 and 11. This is done by controlling the various actuators of the articulated arm 200 and of the boom 201. The approach towards the surface to be cleaned is monitored by the sensor members 217 which have a safety role in relation to visual guidance by the vehicle driver. With the vehicle stationary the driver can clean circular areas on the ground, floors, walls or ceiling by appropriate displacement of the articulated member.

Displacement of the vehicle makes it possible to clean in strips aligned with the direction of advance of the vehicle in forward motion at a low speed (approximately 1.5 kph).

I claim:

1. A washing device mounted on a motor vehicle comprising at least one cold water tank, means carrying water from said at least one cold water tank to means for heating, said means for heating comprising a high-pressure boiler adapted to deliver hot water at a pressure of 100 to 250 bars, means for supplying the pressurized hot water to a rotary cleaning arm fitted with at least one nozzle capable of directing a jet of pressurized hot water to a surface to be cleaned, and a protective casing surrounding said rotary cleaning arm.

2. A washing device according to claim 1, wherein said rotary arm has a vertical axis of rotation, and is mounted on the underside of the vehicle with the at least one nozzle directed at the ground which defines the surface to be cleaned.

3. A washing device according to claim 2, further comprising means for raising and lowering said rotary arm between a cleaning position in immediate proximity of the ground and a standby position spaced above the ground, raising and lowering movement of said rotary arm being substantially rectilinear and parallel to the vertical axis of rotation.

4. A washing device according to claim 3, wherein said means for raising and lowering said rotary arm comprises a hydraulic actuator substantially coaxial with said vertical axis of rotation.

5. A washing device according to claim 4, wherein a rotary joint for bringing pressurized hot water to said at least one nozzle and a fluid motor for rotating said rotary arm are arranged between said hydraulic actuator and said rotary arm.

6. A washing device according to claim 5, wherein a rearward one of said at least one cold water tank is rearwardly pivotable to permit access to an engine located at the rear of the motor vehicle.

7. A washing device according to claim 2, wherein the motor vehicle has front and rear wheels, said rotary cleaning arm and the protective casing therefor being arranged between said front and rear wheels.

8. A washing device according to claim 2, wherein said at least one cold water tank comprising two cold water tanks arranged on said motor vehicle behind an operator's cab, said high pressure boiler being disposed between said two cold water tanks.

9. A washing device according to claim 3, wherein guide rollers are provided on said protective casing for engagement with ground when said rotary arm is in its cleaning position.

10. A washing device according to claim 1, wherein said rotary arm is connected to a hollow shaft communicating with said at least one nozzle, a rotary joint for bringing said means for supplying pressurized hot water into communication with said hollow shaft, said rotary joint comprising an inner part rotatable relative to an outer part, said casing being fixed relative to said outer part.

11. A washing device according to claim 1, wherein said protective casing has a cylindrical skirt depending from an end wall.

12. A washing device according to claim 1, wherein said rotary cleaning arm is entirely contained within said protective casing.

13. A washing device mounted on a motor vehicle comprising at least one cold water tank, means carrying water from said at least one cold water tank to means for heating, said means for heating comprising a high-pressure boiler adapted to deliver hot water at a pressure of 100 to 250 bars, means for supplying the pressurized hot water to a rotary cleaning arm fitted with nozzles capable of directing a jet of pressurized hot water to a surface to be cleaned, said nozzles being of substantially identical flat triangular shape, said nozzles having outlet apertures subsumed by an angle $\beta$ of 15° 4020 .

14. A washing device mounted on a motor vehicle comprising at least one cold water tank, means carrying water from said at least one cold water tank to means for heating, said means for heating comprising a high-pressure boiler adapted to deliver hot water at a pressure of 100 to 250 bars, means for supplying the pressurized hot water to a rotary cleaning arm having an axis of rotation, said rotary arm being fitted with two nozzles, one on each side of said axis of rotation, said nozzles being capable of directing a jet of pressurized hot water to a surface to be cleaned, motor means ensuring the rotation of said rotary cleaning arm, the angle of inclination $\gamma$ of each of said nozzles with respect to the axis of rotation of the rotary cleaning arm being substantially identical and one of the nozzles being directed in the direction of rotation, the other being directed opposite the direction of rotation, so that the angles of attack of jets from said nozzles on the surface to be cleaned are different.

15. A washing device according to claim 14, wherein the mean general planes of said nozzles are inclined at an angle $\gamma$ to the axis of rotation of said rotary cleaning arm, said angle $\gamma$ being between 0° and 30°.

16. A washing device according to claim 15, wherein said nozzles are arranged at opposite ends of said rotary cleaning arm and at equal radial distances from the axis of rotation thereof.

17. A washing device according to claim 14, wherein said means for supplying ensures that said nozzles have a pressurized hot water flow rate between 0.5 and 3 $m^3/h$.

18. A washing device mounted on a motor vehicle comprising at least one cold water tank, means carrying water from said at least one cold water tank to means for heating, said means for heating comprising a high-pressure boiler adapted to deliver hot water at a pressure of 100 to 250 bars, means for supplying the pressurized hot water to a rotary cleaning arm fitted with at least one nozzle capable of directing a jet of pressurized hot water to a surface to be cleaned, wherein said rotary arm has a vertical axis of rotation, and is mounted on the underside of the vehicle with the nozzle directed at the ground which defines the surface to be cleaned, and a rinsing manifold is provided at one end of said vehicle, said rinsing manifold being pivoted at one end and actuator means being provided spaced from said one end of said rinsing manifold for raising, lowering and angularly moving the rinsing manifold toward and away from the rest of the vehicle.

19. A washing device according to claim 18, wherein said rinsing manifold is arranged at the front end of said motor vehicle for facilitating its visibility from a cab at the front end of the vehicle.

20. A washing device according to claim 18, wherein said rinsing manifold is disposed at the rear of said vehicle and said rotating arm is disposed between front and rear wheels of said vehicle whereby the ground surface can be washed and rinsed in one pass of the vehicle.

21. A washing device mounted on a motor vehicle comprising at least one cold water tank, means carrying water from said at least one cold water tank to means for heating, said means for heating comprising a high-pressure boiler adapted to deliver hot water at a pressure of 100 to 250 bars, means for supplying the pressurized hot water to a rotary cleaning arm fitted with at least one nozzle capable of directing a jet of pressurized hot water to a surface to be cleaned, wherein said rotary cleaning arm is mounted proximate to an end of an articulated arm, and motor means rotating said rotary cleaning arm on said articulated arm.

22. A washing device according to claim 21, wherein said articulated arm comprises a first segment pivotally mounted about a vertical axis, a second segment articulated to said first segment, and a third segment at an end of said second segment remote from said first segment, said rotary cleaning arm being arranged at a free end of said third segment.

23. A washing device according to claim 22, wherein actuators are provided for controlling said rotary cleaning arm for movement between operating positions above ground level, at ground level, in front of said vehicle and laterally of said vehicle, and a transport position atop the vehicle body.

24. A washing device according to claim 22, wherein the length of the rotary cleaning arm is less than the width of the vehicle.

25. A washing device mounted on a motor vehicle comprising at least one cold water tank, means carrying water from said at least one cold water tank to means for heating, said means for heating comprising a high-pressure boiler adapted to deliver hot water at a pressure of 100 to 250 bars, means for supplying the pressurized hot water to a rotary cleaning arm fitted with at least one nozzle capable of directing a jet of pressurized hot water to a surface to be cleaned, wherein said rotary arm has a vertical axis of rotation, and is mounted on the underside of the vehicle with the nozzle directed at the ground which defines the surface to be cleaned further comprising means for raising and lowering said rotary arm between a cleaning position in immediate proximity of the ground and a standby position spaced above the ground, raising and lowering movement of said rotary arm being substantially rectilinear and parallel to the vertical axis of rotation.

* * * * *